US007140515B2

(12) United States Patent
Cardwell, III et al.

(10) Patent No.: US 7,140,515 B2
(45) Date of Patent: Nov. 28, 2006

(54) MANUALLY MANIPULABLE ACTUATOR MECHANISM HAVING CONSTRAINED RANGE OF MOTION

(75) Inventors: Walter Wilcox Cardwell, III, Austin, TX (US); Jon Anderson, Austin, TX (US)

(73) Assignee: Vermilion Corporation, Austin, TX (US)

( * ) Notice: Subject to any disclaimer, the term of this patent is extended or adjusted under 35 U.S.C. 154(b) by 346 days.

(21) Appl. No.: 10/713,974

(22) Filed: Nov. 14, 2003

(65) Prior Publication Data

US 2005/0103806 A1 May 19, 2005

(51) Int. Cl.
*B67D 5/06* (2006.01)

(52) U.S. Cl. ..... 222/183; 222/325; 222/402.13; 222/402.15

(58) Field of Classification Search ..... 222/182–183, 222/402.13, 402.15, 402.1, 402.21, 402.11, 222/325
See application file for complete search history.

(56) References Cited

U.S. PATENT DOCUMENTS 2,689,902 A 9/1954 Burtman
3,386,631 A 6/1968 Kotuby
4,426,026 A * 1/1984 Knickerbocker ..... 222/402.13
4,880,143 A 11/1989 Murray et al.
4,883,204 A * 11/1989 Kay et al. ..... 222/192
4,991,749 A * 2/1991 Kay et al. ..... 222/384
5,207,657 A * 5/1993 Gibilisco ..... 604/295
5,263,616 A * 11/1993 Abplanalp ..... 222/402.13
5,875,934 A * 3/1999 Miller et al. ..... 222/183
6,135,321 A 10/2000 Hippensteel
6,199,726 B1 3/2001 Cardwell et al.
6,305,580 B1 10/2001 Chen
6,398,082 B1 6/2002 Clark et al.

* cited by examiner

*Primary Examiner*—Frederick C. Nicolas
(74) *Attorney, Agent, or Firm*—Brian F. Russell; Dillon & Yudell LLP

(57) ABSTRACT

A manually manipulable actuator mechanism includes a body and a manually manipulable element. The body has at least one wall element having a length extending along a first axis and a height extending along a second axis orthogonal to the first axis. The manually manipulable element has a button portion adapted for human digital manipulation and at least one wing portion extending outwardly from the button portion. The manually manipulable element is movable along the first axis between a first position in which an operative element is in a non-actuated condition and a second position in which the operative element is in an actuated condition. The wall element, which has a first height at the first position and a different second height at the second position, cooperates with the wing portion to constrain movement of the manually manipulable element at least along a third axis orthogonal to the first and second axes while the manually manipulable element is moved between the first and second positions.

31 Claims, 6 Drawing Sheets

MANUALLY MANIPULABLE ACTUATOR MECHANISM HAVING CONSTRAINED RANGE OF MOTION

CROSS-REFERENCE TO RELATED PATENT

The present application is related to U.S. Pat. No. 6,199,726, which is incorporated herein by reference in its entirety as background material.

BACKGROUND OF THE INVENTION

1. Technical Field

The present invention relates in general to actuator mechanisms, and in particular, to manually manipulable actuator mechanisms having a constrained range of motion.

2. Description of the Related Art

Manually manipulable actuator mechanisms are commonly employed to actuate or facilitate the operation or function of electronic, electromechanical and mechanical systems. These manually manipulable actuator mechanisms include a wide variety of push buttons, switches, dials, sliders, knobs, triggers and other actuator mechanisms.

A primary consideration in the design of an actuator mechanism is the range of motion through which the actuator mechanism will be permitted to move when subjected to anticipated levels of manual force. The range of motion through which an actuator mechanism moves can influence consumer perception of the overall system because too much "play" in the actuator mechanism is often taken as an indication of poor system design and/or quality. Moreover, the failure to properly constrain the range of motion of the actuator mechanism can lead to breakage of the actuator mechanism or improper operation of the system, for example, if the actuator mechanism is subject to greater than necessary force or force in a direction other than that required to actuate the system.

SUMMARY OF THE INVENTION

In view of the foregoing, the present invention provides an actuator mechanism for electrical, electromechanical and mechanical systems that provides improved control of the range of motion through which the actuator mechanism is permitted to move.

In one embodiment of the present invention, a manually manipulable actuator mechanism includes a body and a manually manipulable element. The body has at least one wall element having a length extending along a first axis and a height extending along a second axis orthogonal to the first axis. The manually manipulable element has a button portion adapted for human digital manipulation and at least one wing portion extending outwardly from the button portion. The manually manipulable element is movable along the first axis between a first position in which an operative element is in a non-actuated condition and a second position in which the operative element is in an actuated condition. The wall element, which has a first height at the first position and a different second height at the second position, cooperates with the wing portion to constrain movement of the manually manipulable element at least along a third axis orthogonal to the first and second axes while the manually manipulable element is moved between the first and second positions.

All objects, features, and advantages of the present invention will become apparent in the following detailed written description.

BRIEF DESCRIPTION OF THE DRAWINGS

The novel features believed characteristic of the invention are set forth in the appended claims. However, the invention, as well as a preferred mode of use, will best be understood by reference to the following detailed description of an illustrative embodiment when read in conjunction with the accompanying drawings, wherein:

DETAILED DESCRIPTION OF ILLUSTRATIVE EMBODIMENT

Figure 1A:
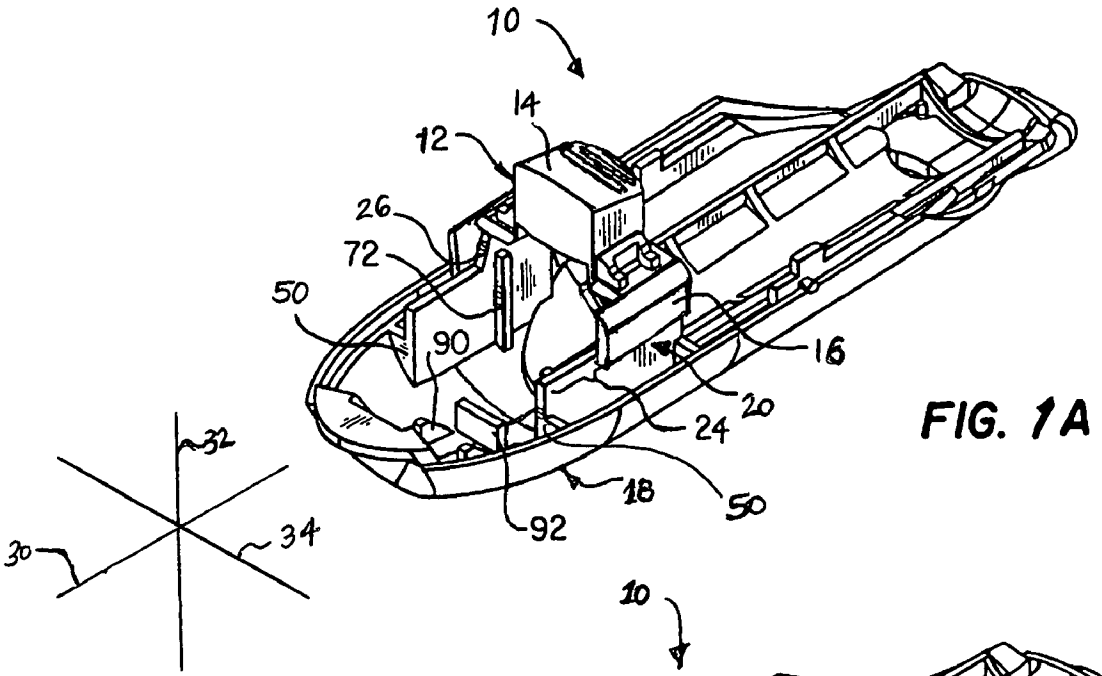
FIGS. 1A and 1B illustrate an exemplary actuator mechanism in accordance with the present invention in non-actuated and actuated positions, respectively.
Figure 1B:
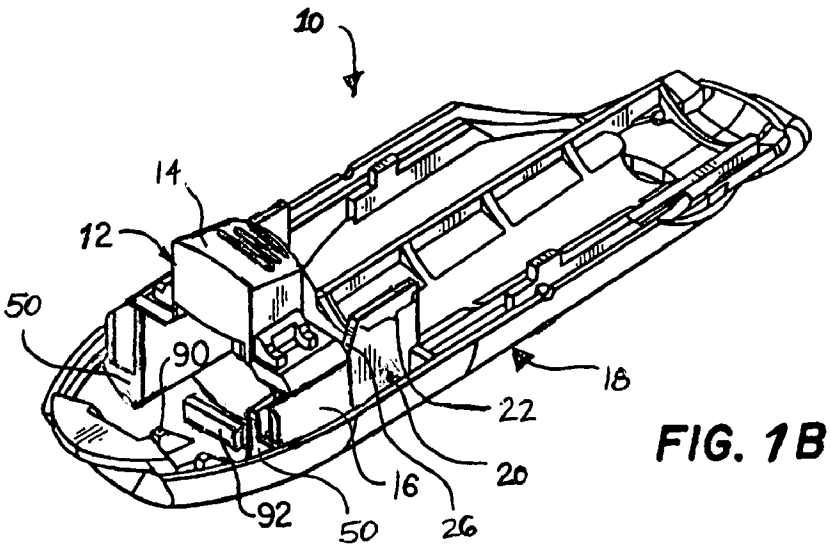

With reference now to the figures, and in particular with reference to FIGS. 1A–1B, two views of a system 10 having an exemplary actuator mechanism in accordance with the present invention are shown. FIG. 1A depicts system 10 with the actuator mechanism in a first, non-actuated position, and FIG. 1B depicts system 10 with the actuator mechanism in a second, actuated position.

The actuator mechanism includes at least a manually manipulable element 12 and a means for constraining the range of motion of manually manipulable element 12. In the depicted embodiment, the means for constraining the range of motion of manually manipulable element 12 includes at least one and in this case, two wall portions 20 of a body 18 within system 10. Wall portions 20, which are generally parallel, have a length generally extending along a first axis 30 and a height generally extending along an orthogonal second axis 32. Wall portions 20 may be integrally formed with body 18 (e.g., by molding) or may be joined to or mounted on body 18 by other conventional techniques selected based upon the materials employed.

Although not required by the present invention, the height of wall portions 20 may vary along first axis 30, for example, by increasing or decreasing as manually manipulable element 12 is moved from the first position illustrated in FIG. 1A and the second position shown in FIG. 1B. In the depicted embodiment, wall portions 20 comprise a first extent 22 having a substantially uniform greater height, a second extent 24 having a substantially uniform lesser height, and a steeply sloping intermediate extent 26.

Figure 2A:
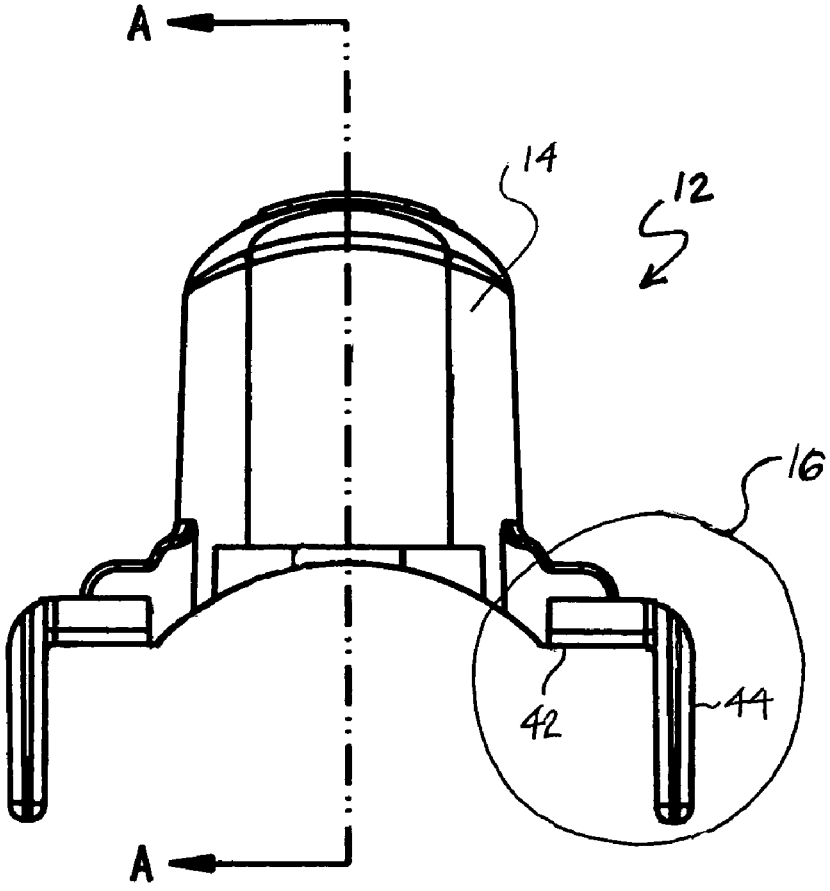
FIGS. 2A, 2B and 2C respectively depict side, section and bottom views of an exemplary manually manipulable element in accordance with the present invention.
Figure 2C:
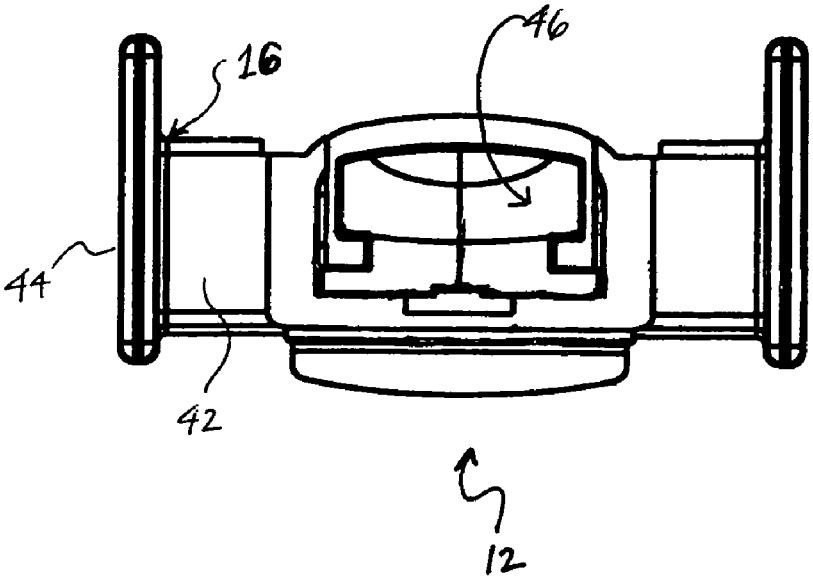
Figure 2B:
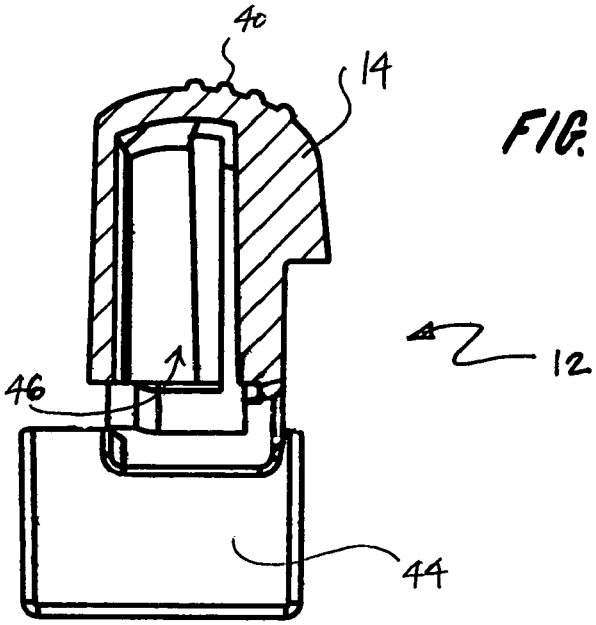

As shown in FIGS. 1A–1B and as illustrated in greater detail in FIGS. 2A–2C, manually manipulable element 12 includes a button portion 14 and one or more (and this case two) wing portions 16 extending outwardly from button portion 14. Button portion 14, which may have a wide variety of shapes including the mounded form shown in FIG. 2A, is preferably sized for comfortable human digital manipulation and may have a profile or texture on at least one surface, such as that provided by integral ridges 40, to enhance frictional contact with a user's digit for ease of manipulation. Wing portions 16 are preferably integrally formed with button portion 14 and are sized and configured to cooperate with the one or more wall portions 20 to constrain the range of motion of manually manipulable element 12.

For example, in the depicted embodiment, wing portions 16 are generally L-shaped and include a horizontal leg 42 and a vertical leg 44, which are sized to span wall portions 20 such that horizontal legs 42 (and manually manipulable element 12) are supported by the upper surface of wall portions 20. Thus, wing portions 16 constrain the range of motion of manually manipulable element 12 along second axis 32 in accordance with the respective heights of wall portions 20 at each position along first axis 30. Vertical legs 44 of manually manipulable element 12 further constrain the range of motion of manually manipulable element 12 along second axis 34 by engaging at least one of wall portions 20 and/or an interior surface of body 18 when a maximum extent of motion is reached.

Wing portions 16 may further constrain the range of motion of manually manipulable element 12 along first axis 30 when manually manipulable element 12 is in the second position shown in FIG. 1B. In particular, wing portions 16 may be sized and configured so that the leading edges of wing portions 16 engage respective stops 50 when a maximum extent of translation in a first direction along first axis 30 is reached. And because the height of second extent 24 is substantially less than that of first extent 22, when manually manipulable element 12 is at the second position, the trailing edge of manually manipulable element 12 engages intermediate extent 26 (or alternatively a second stop disposed between wall portions 20 and body 18) to constrain translational movement of manually manipulable element 12 in a second direction along first axis 30. At the second position, rotation of manually manipulable element 12 about third axis 34 is also constrained by the engagement of the leading edges of vertical legs 44 with stops 50 and the trailing edges of horizontal legs 42 with intermediate extents 26.

It will be appreciated that in alternative embodiments, wing portions 16 may be sized and configured to cooperate with wall portions 20 and body 18 in manner different from that depicted in FIGS. 1A–1B. For example, wing portions 16 may be configured so that the bottom edges of vertical legs 44 support manually manipulable element 12. Additionally or alternatively, one or more of wing portions 20 may cooperate with the interior rather than the exterior surfaces of wall portions 20 to constrain the range of motion along third axis 34.

Depending upon the selected application, it may be desirable or even required for manually manipulable element 12 to be coupled to one or more additional elements to facilitate the actuation of system 10. As shown in FIG. 2C as well as FIG. 2B, which is a section view taken along line A—A of FIG. 2A, coupling of manually manipulable element 12 to another element manually manipulable element 12 is facilitated by molding or tooling within button portion 14 an interior cavity 46 suitable for receiving an attachment tab of another element.

Figure 3:
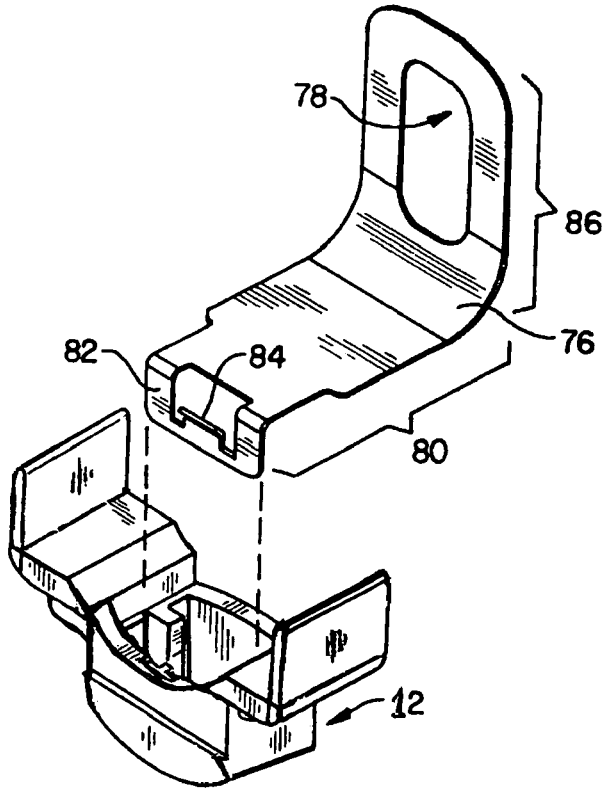
FIG. 3 illustrates the mating of the manually manipulable element of FIGS. 2A–2C with a spring in accordance with one embodiment of the present invention.

For example, interior cavity may receive an attachment tab of a slidable switch. Alternatively, as indicated in FIG. 3 with dashed lines, an attachment tab 82 of a spring 76 may be received within a corresponding slot in the interior cavity 46, with an integral spring member 84 engaging an interior surface of manually manipulable element 12. Manually manipulable element 12 may be retained on attachment tab 82, for example, by interference fit, spring tension, or suitable epoxy. In the depicted embodiment, spring 76, which may be identical to that disclosed in the above-referenced patent, is L-shaped and has a first leg 80 terminating in attachment tab 82 and a second leg 86 in which an opening 78 is formed.

Figure 4A:
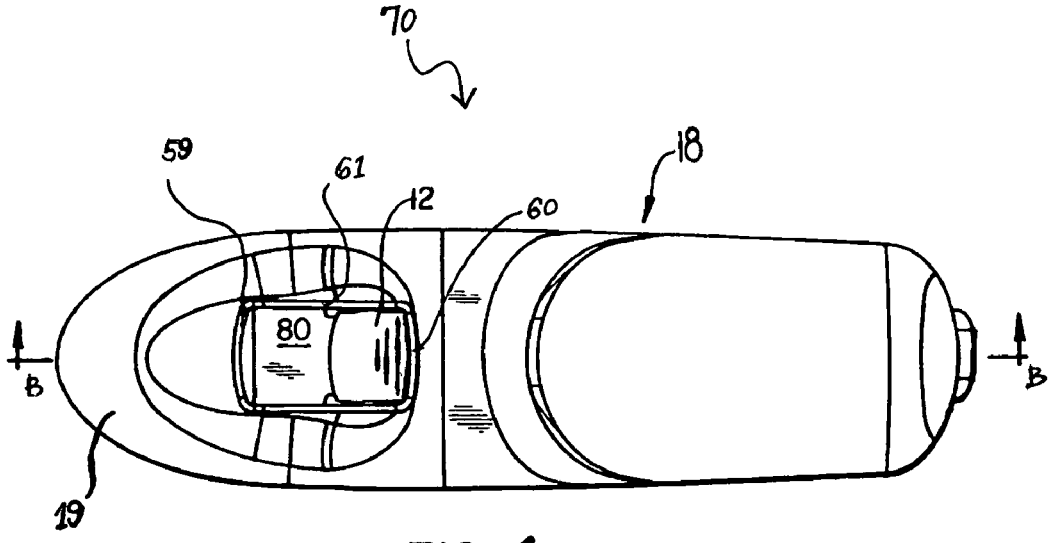
FIG. 4A depicts a top view of an aerosol dispensing system in which the actuator mechanism of the present invention may advantageously be incorporated.
Figure 4B:
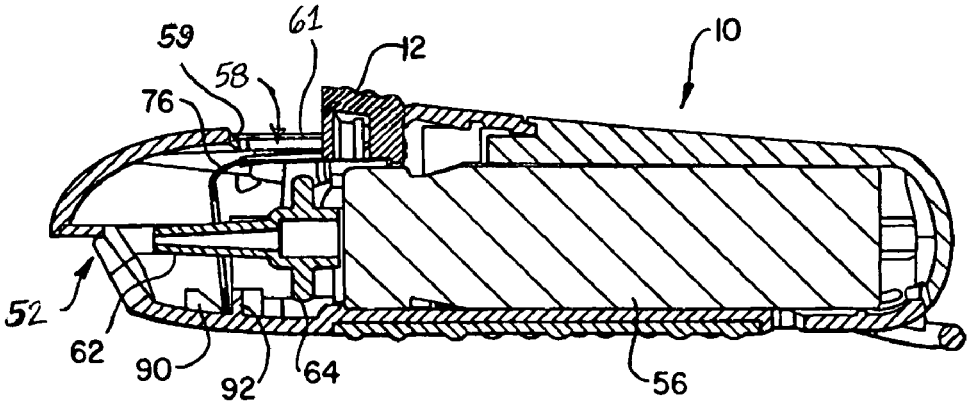
FIGS. 4B and 4C are section views illustrating the actuator mechanism of FIG. 4A in non-actuated and actuated positions, respectively.
Figure 4C:
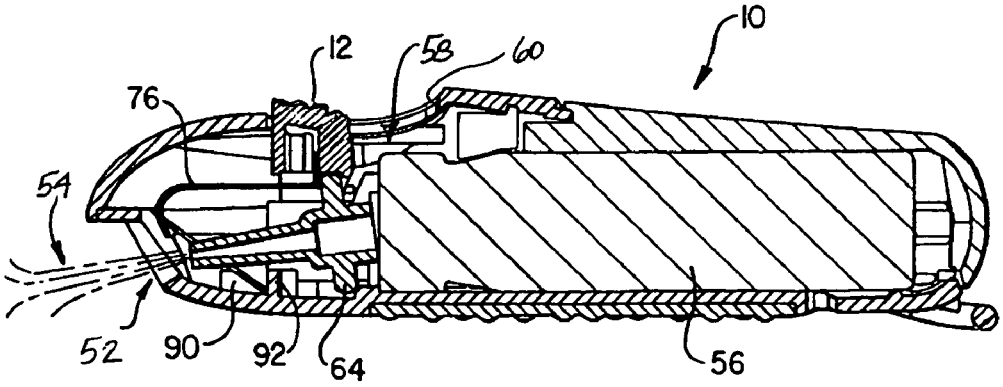

FIGS. 4A–4C illustrate the use within an aerosol dispensing system 70 of an actuator mechanism as shown in FIGS. 1A–1B together with a spring 76 as shown in FIG. 3. FIGS. 4B–4C, which are section views of aerosol dispensing system 70 taken along line B—B of FIG. 4A, depict aerosol dispensing system 70 in non-actuated and actuated conditions, respectively.

In aerosol dispensing system 70, body 18 includes or is coupled to a top housing 19 that, together with the remainder of body 18, defines an interior volume that is sized to receive and enclose a pressurized canister 56 containing a substance to be dispensed. Pressurized canister 56 includes a nozzle 62 that is substantially aligned, at least during dispensing of the substance 54, with an aperture 52. Canister 56 remains substantially stationary with respect to body 18, with its forward travel (i.e., toward aperture 52) constrained by molded stops such as a pair of posts 72 (only one of which can be seen in FIG. 1A) that engage the shoulder 74 of canister 56.

In top housing 19, a slot 58 is formed through which button portion 14 of manually manipulable element 12 protrudes. As seen best in FIGS. 4B–4C, spring 76 is installed within top housing 19 with the terminating end of second leg 86 captured between one or more ramps 90 and a wall 92 integral to body 18. Nozzle 62 of canister 76 passes through opening 78 in spring 76. With this arrangement, spring 76 urges manually manipulable element 12 toward the first position depicted in FIG. 4B.

When manually manipulable element 12 is in the first position depicted in FIG. 4B, manually manipulable element 12 is constrained from substantial movement along second axis 32 by the first extent of wall elements 20 and top housing 19. In addition, nozzle 62 remains in axial alignment with canister 56. Accordingly, the toggle valve of canister 56 is closed, and the substance stored under pressure within canister 56 is not dispensed. As shown in FIGS. 4A–4B, with manually manipulable element 12 in first position, first leg 80 of spring 76 also advantageously blocks access to the interior of aerosol dispensing system 70 through slot 58, thus preventing inadvertent dispensing of the substance in canister 56 due to an object contacting nozzle 62 through slot 58.

In order to move manually manipulable element 12 from the first position shown in FIG. 4B to the second position shown in FIG. 4C, the user translates manually manipulable element 12 axially forward against the urging of spring 76, preferably with the thumb of his or her hand. As manually manipulable element 12 is moved axially forward from the first position, substantial downward movement of manually manipulable element 12 along second axis 32 is prevented as long as wing portions 16 rest on first extent 20 of wall elements 20. However, once wing portions 16 clear first extent 20 of wall portions 20, manually manipulable element 12 may selectively be driven downward along second axis 32 against the urging of spring 76. Second extents 24 of wall portions 20 are sufficiently different in height from first extents 20 to permit one or both of manually manipulable element 12 and first leg 80 of spring 76 to engage enlarged diameter portion 64 of nozzle 62. As shown in FIG. 4C, nozzle 62 is thereby diverted from axial alignment with canister 56 against the combined spring force of spring 76 and the toggle valve spring, thus forcing the toggle valve open and dispensing substance 54 from canister 56 as a result of the pressure differential between the ambient environment and the interior of canister 56. When the force applied to manually manipulable element 12 diminishes to less than the spring force of spring 76, the urging of spring 76 automatically returns manually manipulable element 12 to the first position shown in FIG. 4B, and the spring force of the toggle valve closes the toggle valve and returns nozzle 62 to axial alignment with canister 56, as also shown in FIG. 4B.

It should further be noted that slot 58 is preferably sized and configured to cooperate with wall portions 20 in constraining the range of motion of manually manipulable element 12. For example, in a preferred embodiment, the anterior edge 59 of slot 58 is axially forward of the second position of manually manipulable element 12 shown in FIG. 4C so that the translation of manually manipulable element 12 from the first position shown in FIG. 4C to the second position is not impeded. However, anterior edge 59 engages the leading edge of button portion 14 to constrain manually manipulable element 12 if force is applied to rotate button portion 14 about third axis 34. Posterior edge 60 of slot 58 similarly engages the trailing edge of button portion 14 to prevent excessive backward translation along first axis 30 and excessive rotation about third axis 34. Side edges 61 of slot 58 further cooperate with wall portions 20 to constrain the translation of button portion 14 along third axis 34 and rotation of button portion 14 about first axis 30. By constraining manually manipulable element 12 in this way, spring 76 is protected against deformation and breakage, and detachment of manually manipulable element 12 from attachment tab 82 is prevented. Moreover, constraining manually manipulable element 12 in this manner imparts a "solid" tactile impression, which to most users connotes quality, thoughtful design, and reliability.

Figure 5A:
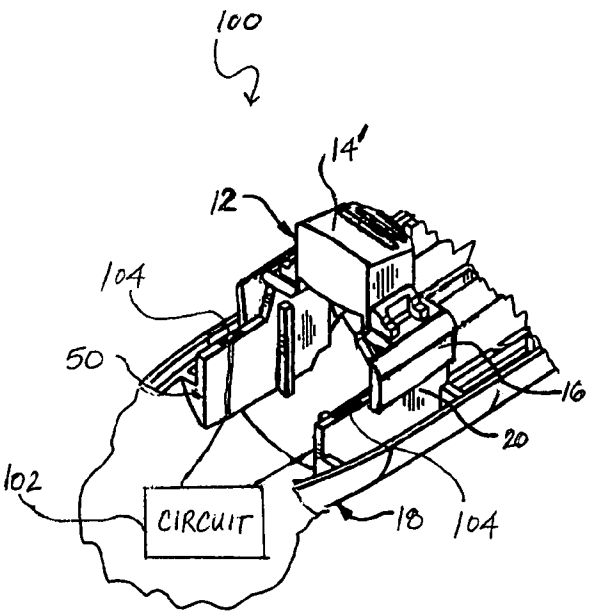
FIGS. 5A and 5B depict an exemplary actuator mechanism for an electrical system in non-actuated and actuated positions, respectively.
Figure 5B:
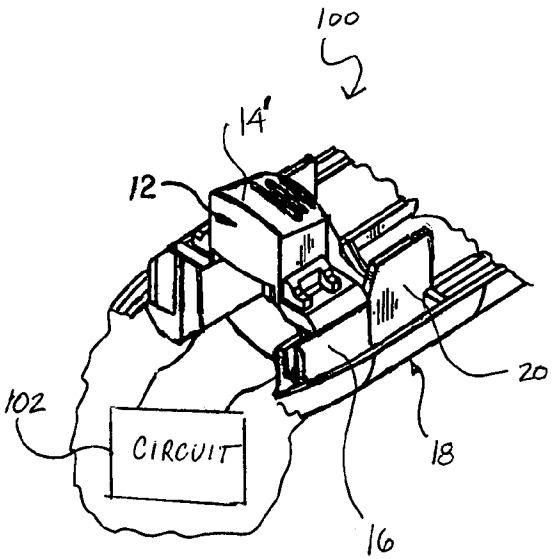

Referring now to FIGS. 5A–5B, there are depicted two views of an exemplary actuator mechanism for an electrical system 100 in non-actuated and actuated conditions, respectively. As can be seen by comparison of FIGS. 5A–5B to FIGS. 1A–1B, system 100 depicted in FIGS. 5A–5B is substantially similar to system 10 described above, except for the inclusion of an electrical circuit 102 and electrically conductive elements to facilitate the actuation of electrical circuit 102.

As shown in FIG. 5A, electrical circuit 102 is electrically coupled to electrically conductive contacts 104 formed on or in wall portions 20 and/or the hidden surfaces of stops 50. With this arrangement, electrical circuit 102, which may be a power circuit, is in a non-actuated condition in FIG. 5A due to the open circuit that exists between electrical contacts 104.

Figure 5C:
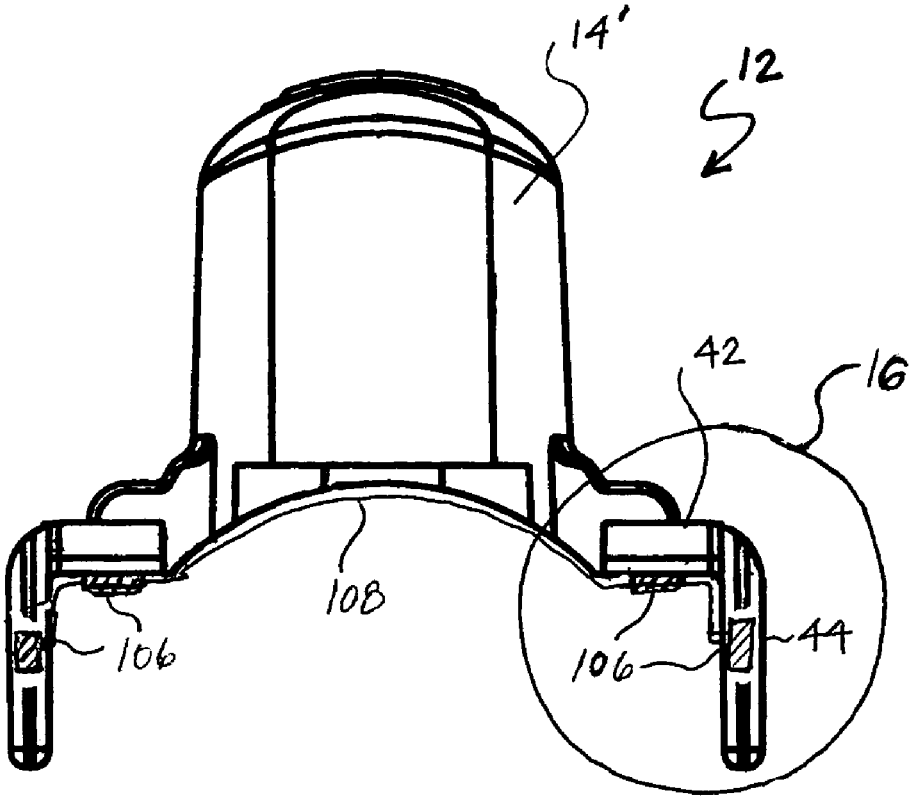
FIG. 5C is a side view of a manually manipulable element having electrical contacts in accordance with one embodiment of the present invention.

To permit electrical connection between electrically conductive contacts 104, manually manipulable element 14' includes two or more electrically conductive contacts 106 at locations corresponding those of electrically conductive contacts 104, as illustrated in FIG. 5C. Electrically conductive contacts 106 are electrically connected by an electrical conductor 96. With this arrangement, a user actuates electrical circuit 102 (and/or the larger system 100) by moving manually manipulable element 14' to the second position depicted in FIG. 5B, thereby completing a conductive loop through corresponding contacts 104, 106 and conductor 108.

It should be understood upon reference to the foregoing that wall portions 20 in FIGS. 5A–5B may have different profiles than that illustrated and that system 100 may or may not include a spring element (such as spring 76), depending upon the intended application of system 100. System 100 may further include a top housing (such as top housing 19) to further constrain the range of motion of the actuator mechanism.

As has been described, the present invention provides an improved manually manipulable actuator apparatus for a mechanical, electromechanical or electrical system. The actuator apparatus includes a manually manipulable element having wings that cooperate with one or more wall elements to constrain the range of motion of manually manipulable element. The improved translation and rotational constraint provided by the present invention reduces the likelihood of system damage and/or failure and improves user perception of the quality, design and reliability of the overall system.

While the invention has been particularly shown as described with reference to a preferred embodiment, it will be understood by those skilled in the art that various changes in form and detail may be made therein without departing from the spirit and scope of the invention.

What is claimed is:

1. A manually manipulable actuator apparatus, comprising:

a body having at least one wall element having a length generally extending along a first axis and a height extending along a second axis orthogonal to said first axis, wherein said height varies along said first axis; and a manually manipulable element having a button portion for human digital manipulation and at least one wing portion extending outwardly from said button portion, said at least one wing portion including a leg that overlaps said height of said wall along said second axis, wherein said manually manipulable element is movable along said first axis between a first position in which an operative element is in a non-actuated condition and a second position in which the operative element is in an actuated condition, wherein said at least one wall element has a first height at said first position and a different second height at said second position, and wherein said at least one wall element cooperates with said leg of said at least one wing portion to constrain movement of said manually manipulable element along a third axis orthogonal to said first and second axes while said manually manipulable element is moved between said first and second positions.

2. The apparatus of claim 1, wherein said manually manipulable element is supported by said at least one wall element and movement of said manually manipulable element along said second axis is constrained by said at least one wall element.

3. The apparatus of claim 2, wherein said at least one wall element comprises at least first and second wall elements.

4. The apparatus of claim 1, wherein said second height is less than said first height.

5. The apparatus of claim 4, wherein said body further includes a stop that constrains movement of said manually manipulable element along said first axis beyond said second position, wherein a second extent of said at least one wall element having said second height is sized to tightly accommodate said manually manipulable element between said stop and a first extent of said at least one wall element having said first height.

6. The apparatus of claim 5, wherein said stop is positioned within said body such that, when said manually manipulable element is in said second position, rotation of said button portion about said third axis is constrained by said at least one wing element engaging said stop.

7. The apparatus of claim 1, and further comprising a spring element, coupled to said manually manipulable element and engaging said body, that urges said manually manipulable element along said first axis toward said first position.

8. The apparatus of claim 1, wherein said at least one wing portion comprises at least first and second wing portions.

9. The apparatus of claim 1, wherein said at least one wing portion comprises a generally L-shaped wing portion, having an attached end coupled to said button portion and a free end.

10. The apparatus of claim 1, wherein:

said body further comprises a housing at least partially enclosing said at least one wing portion; and said button portion at least partially extends from said body.

11. The apparatus of claim 10, wherein said housing and said at least one wall portion together constrain substantial rotation of said manually manipulable element about said first and second axes.

12. The apparatus of claim 1, and further comprising the operative element, wherein said body comprises a dispenser and wherein said operative element comprises a valve.

13. The apparatus of claim 1, and further comprising the operative element, wherein said operative element comprises an electrical circuit.

14. A manually manipulable actuator apparatus, comprising:

a body having at least one wall element having a length generally extending along a first axis and a height extending along a second axis orthogonal to said first axis;

a manually manipulable element having a button portion for human digital manipulation and at least one wing portion extending outwardly from said button portion, said at least one wing portion including a leg that overlaps said height of said wall along said second axis, wherein said manually manipulable element is movable along said first axis between a first position in which an operative element is in a non-actuated condition and a second position in which the operative element is in an actuated condition, and wherein said at least one wall element cooperates with said leg of said at least one wing portion to constrain movement of said manually manipulable element along a third axis orthogonal to said first and second axes while said manually manipulable element is moved between said first and second positions; and a spring element, coupled to said manually manipulable element and engaging said body, that urges said manually manipulable element along said first axis toward said first position.

15. The apparatus of claim 14, wherein said manually manipulable element is supported by said at least one wall element and movement of said manually manipulable element along said second axis is constrained by said at least one wall element.

16. The apparatus of claim 15, wherein said at least one wall element comprises at least first and second wall elements.

17. The apparatus of claim 14, wherein said height of said at least one wall element varies along said first axis, such that said at least one wall element has a first height at said first position and a second height at said second position.

18. The apparatus of claim 17, wherein said second height is less than said first height.

19. The apparatus of claim 18, wherein said body further includes a stop that constrains movement of said manually manipulable element along said first axis beyond said second position, wherein a second extent of said at least one wall element along said first axis having said second height is sized to tightly accommodate said manually manipulable element between said stop and a firs extent of said at least one wall element having said first height.

20. The apparatus of claim 19, wherein said stop is positioned within said body such that, when said manually manipulable element is in said second position, rotation of said button portion about said third axis is constrained by said at least one wing element engaging said stop.

21. The apparatus of claim 14, wherein said at least one wing portion comprises at least first and second wing portions.

22. The apparatus of claim 14, wherein said at least one wing portion comprises a generally L-shaped wing portion having an attached end coupled to said button portion and a free end.

23. The apparatus of claim 14, wherein:

said body further comprises a housing at least partially enclosing said at least one wing portion; and said button portion at least partially extends from said body.

24. The apparatus of claim 23, wherein said housing and said at least one wall portion together constrain substantial rotation of said manually manipulable element about said first and second axes.

25. The apparatus of claim 14, and further comprising the operative element, wherein said body comprises a dispenser and said operative element comprises a valve.

26. The apparatus of claim 14, and further comprising the operative element, wherein said operative element comprises an electrical circuit.

27. A manually manipulable actuator apparatus, comprising:

a body having first and second wall elements each having a length generally extending along a first axis and a height extending along a second axis orthogonal to said first axis, wherein said height varies along said first axis; and a manually manipulable element supported by said first and second wall elements, said manually manipulable element having a button portion adapted for human digital manipulation and first and second wing portions extending outwardly from said button portion, said first and second wing portions each including a respective leg that overlaps said height of said wall along said second axis, wherein said manually manipulable element is movable along said first axis between a first position in which a operative element is in a non-actuated condition and a second position in which the operative element is in a actuated condition, wherein said first and second wall elements have a first height at said first position and a different second height at said second position, and wherein said first and second wall elements cooperate with said legs of said first and second wing portions to constrain movement of said manually manipulable element along a third axis orthogonal to said first and second axes while said manually manipulable element is moved between said first and second positions.

28. The apparatus of claim 27, and further comprising a spring element, coupled to said manually manipulable element and engaging said body, that urges said manually manipulable element along said first axis toward said first position.

29. The apparatus of claim 27, wherein said spring element is further adapted to urge said manually manipulable element along said second axis when said manually manipulable element is at said second position.

30. The apparatus of claim 27, wherein:

said body includes a housing at least partially enclosing said first and second wing portions;

said button portion at least partially extends from said housing; and said housing and said first and second wall portions together constrain substantial rotation of said manually manipulable element about said first and second axes.

31. The apparatus of claim 27, and further comprising an operative element within said body, wherein said operative element comprises a valve.

* * * * *